US006427278B1

(12) United States Patent
McKay, Jr.

(10) Patent No.: US 6,427,278 B1
(45) Date of Patent: Aug. 6, 2002

(54) LINT ROLLER ASSEMBLY

(75) Inventor: Nicholas D. McKay, Jr., Birmingham, MI (US)

(73) Assignee: Helmac Products Corporation, Flint, MI (US)

( * ) Notice: Subject to any disclaimer, the term of this patent is extended or adjusted under 35 U.S.C. 154(b) by 91 days.

(21) Appl. No.: 09/619,792

(22) Filed: Jul. 20, 2000

(51) Int. Cl.[7] ..... A47L 25/00
(52) U.S. Cl. ..... 15/104.002; 15/230.11
(58) Field of Search ..... 15/104.002, 230.11; 492/13, 14, 19

(56) References Cited

U.S. PATENT DOCUMENTS

| | | | | |
|---|---|---|---|---|
| 3,201,815 A | | 8/1965 | Selby | 15/104 |
| 3,343,194 A | | 9/1967 | Ramelson | 15/104 |
| 3,363,276 A | * | 1/1968 | Thomas | 15/104.002 |
| 3,417,418 A | | 12/1968 | Riboud | 15/104 |
| 4,361,923 A | | 12/1982 | McKay | 15/104 A |
| 4,399,579 A | | 8/1983 | McKay | 15/104 |
| 4,422,201 A | | 12/1983 | McKay | 15/104 A |
| 4,427,726 A | | 1/1984 | Wolfrum | 428/43 |
| 4,570,280 A | | 2/1986 | Roth | 15/104 A |
| 4,905,337 A | | 3/1990 | McKay | 15/104 A |
| 5,027,465 A | | 7/1991 | McKay | 15/104 A |
| 6,055,695 A | | 5/2000 | McKay, Jr. | 15/104.002 |
| 6,127,014 A | | 10/2000 | McKay, Jr. | 428/43 |

FOREIGN PATENT DOCUMENTS

| | | | | |
|---|---|---|---|---|
| DE | 3410468 | * | 9/1985 | 15/230.11 |
| JP | 2-177930 | | 7/1990 | |
| JP | 2521127 Y2 | | 12/1996 | |

* cited by examiner

*Primary Examiner*—Gary K. Graham

(57) ABSTRACT

A lint roller assembly is disclosed having an elongated housing with a handle and a lint roller support section longitudinally adjacent the handle. The lint roller support section is substantially cylindrical in shape and has a radially recessed and circumferentially extending channel formed between its ends. This channel has a longitudinal length less than the longitudinal length of the lint roller support section. The lint roller assembly further includes a lint roller having a tubular cylindrical core and an adhesive sheet roll wound about the core. The core has a longitudinal length and inside diameter dimensioned to fit into the channel such that the lint roller is retained to the lint roller support section. The longitudinal length of the core, furthermore, is less than the longitudinal length of the adhesive roll.

8 Claims, 1 Drawing Sheet

LINT ROLLER ASSEMBLY

BACKGROUND OF THE INVENTION

I. Field of the Invention

The present invention relates generally to lint roller assemblies.

II. Description of the Prior Art

There are many previously known lint roller assemblies. These previously known lint roller assemblies typically comprise a handle secured to a cylindrical lint roller support. A tubular cylindrical adhesive lint roller is then removably mounted to the support such that the adhesive roller is rotatable relative to the handle. In use, the adhesive lint roller is rolled along the user's clothes or other area to remove lint, hair and other debris.

Typically, the lint roller comprises a cylindrical tubular cardboard core with the adhesive roll wound about the core. Furthermore, the axial length of the core is substantially the same as the axial length of the adhesive roll.

In order to retain the lint roller to the lint roller support for these previously known assemblies, a radially extending abutment surface is positioned at the junction of the handle with the lint roller support which abuts against one end of the core. A plurality of resilient fingers are then provided at the free end of the lint roller support. These resilient fingers compress radially inwardly in order to allow the core to slide over the lint roller support. When the lint roller is completely inserted over the lint roller support section, the fingers deflect radially outwardly so that a portion of the fingers extends radially outwardly across the free end of the core. In doing so, the core is entrapped between the fingers and the radial abutment surface.

These previously known lint rollers, however, suffer from several disadvantages. One disadvantage is that, since the fingers are positioned along the outer end of the core, as the lint roller rotates on the lint roller support section, the fingers abrade the axial end of the core and create cardboard dust. This dust can then contact the user's clothes thereby comprising the efficiency of the lint roller.

A still further disadvantage of the previously known lint rollers is that, since the inner cardboard core extends along the entire length of the lint roller support, a relatively large area of contact between the core and the lint roller support section is created during the use of the lint roller. This, in turn, inhibits the desired free rotation of the lint roller relative to the lint roller support section.

A still further disadvantage of these previously known lint roller assemblies is that, since the axial length of the core is the same as the axial length of the adhesive roll, the core constitutes a significant portion of the overall cost of the lint roller. Furthermore, after the adhesive roll has been depleted, the core is simply discarded which can result in excessive waste.

SUMMARY OF THE PRESENT INVENTION

The present invention provides a lint roller assembly which overcomes all of the above-mentioned disadvantages of the previously known lint roller assemblies.

In brief, the lint roller assembly of the present invention comprises an elongated housing having a handle and a lint roller support section longitudinally adjacent the handle. The entire housing is preferably of a one-piece plastic construction.

The lint roller support section is substantially cylindrical in shape and includes a radially recessed and circumferentially extending channel formed between its ends. This channel, furthermore, has a longitudinal length less than the longitudinal length of the lint roller support section.

The lint roller assembly further comprises a lint roller having a tubular cylindrical core and an adhesive sheet roll wound about the core. This core has a longitudinal length and inside diameter dimensioned to fit into the lint roller support section channel. Furthermore, the longitudinal length of the adhesive roll is substantially the same as the longitudinal length of a lint roller support section and, as such, is substantially less than the longitudinal length of the adhesive roll.

The inside diameter of the core is substantially the same or slightly less than the outside diameter of the lint roller support section. Thus, in use, the lint roller is pushed over the free end of the lint roller support section until the core registers with the channel. When this happens, the core is received into the channel and the abutment between the axial ends of the core with the axial ends of the channel retains the lint roller to the lint roller support section while still ensuring free rotation of the lint roller in use.

Although in the preferred embodiment of the invention, the lint roller includes a single core substantially at the center of the lint roller, alternatively two or even more separated cores are provided at spaced intervals along the lint roller. The total longitudinal or axial length of the cores, however, is less than the total axial length of the lint roller support section. Furthermore, each core registers with and is received within a receiving channel formed on the lint roller support section.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
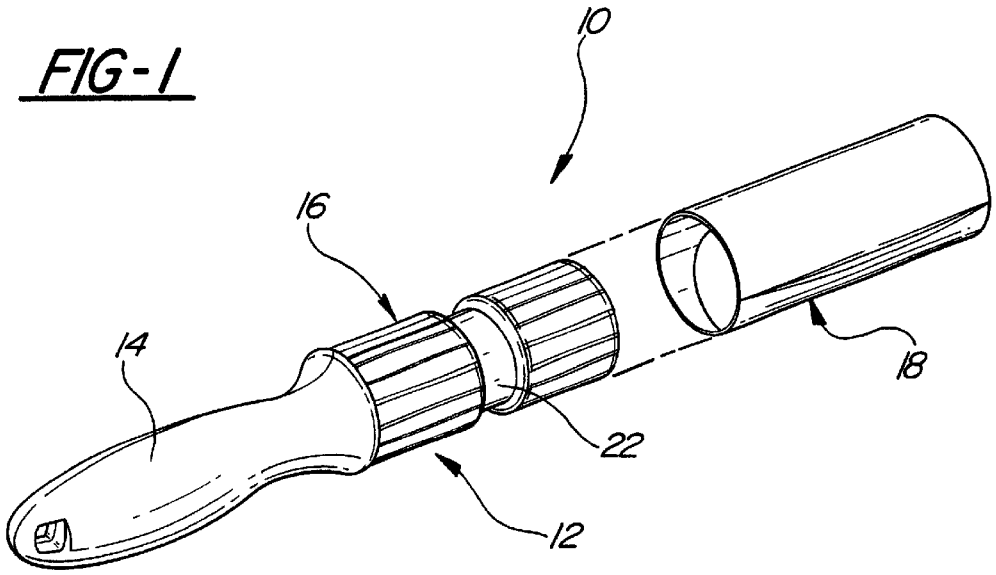
FIG. 1 is an exploded view illustrating a preferred embodiment of the present invention.

With reference first to FIG. 1, an exploded view of the preferred embodiment of the lint roller assembly 10 of the present invention is there shown and comprises an elongated housing 12 having both a handle 14 and a lint roller support section 16. A tubular and cylindrical lint roller 18 is slidably received over the lint roller support section 16 and retained to the lint roller support section 16 in a manner subsequently described in greater detail.

Figure 2:
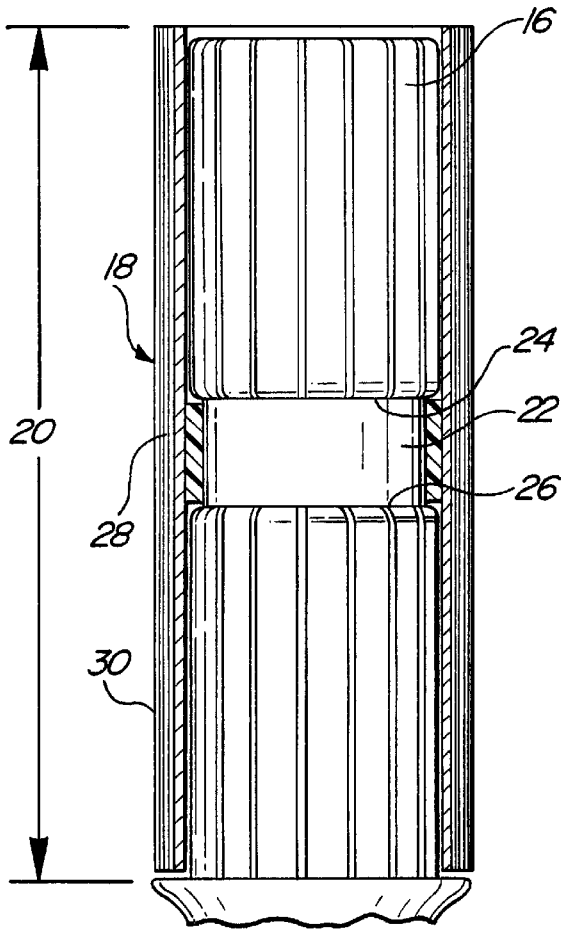
FIG. 2 is a longitudinal sectional view illustrating the preferred embodiment of the present invention.

Referring now to FIGS. 1 and 2, the lint roller support section 16 is generally cylindrical in shape and has a predetermined axial or longitudinal length 20. A radially recessed and circumferentially extending channel 22 is formed at a midpoint of the lint roller support section 16. The channel 22 includes two sides 24 and 26 and the longitudinal length of the channel 22 between its sides 24 and 26 is substantially less than the longitudinal length 20 of the lint roller support section 16.

With reference now particularly to FIG. 2, the lint roller 18 includes a tubular and cylindrical core 28 having an adhesive roll 30 wound about the core 28. This adhesive roll 30 is conventional in construction and includes a backer sheet coated with an adhesive on one side. The adhesive roll 30 may be either continuous or perforated into single sheets wherein the width of each sheet substantially equals the circumference of the adhesive roll 30.

The longitudinal length of the core 28 is substantially the same or slightly less than the longitudinal length of the channel 22. Furthermore, the inside diameter of the core 28 is substantially the same or slightly less than the outside diameter of the lint roller support section 16.

In order to mount the lint roller 18 to the lint roller support section 16, the lint roller 18 is pushed over the lint roller support section 16 until the core 28 registers with the channel 22. Since the channel 22 is dimensioned to receive the core 28, once the core 28 is aligned with the channel 22, the core 28 nests within the channel 22 thus permitting free rotation of the lint roller 18 relative to the lint roller support section 16. However, the abutment between the axial ends of the core 28 with the ends 24 and 26 of the channel 22 retains the lint roller 18 to the lint roller support section 16 until the adhesive roll 30 is depleted.

Figure 3:
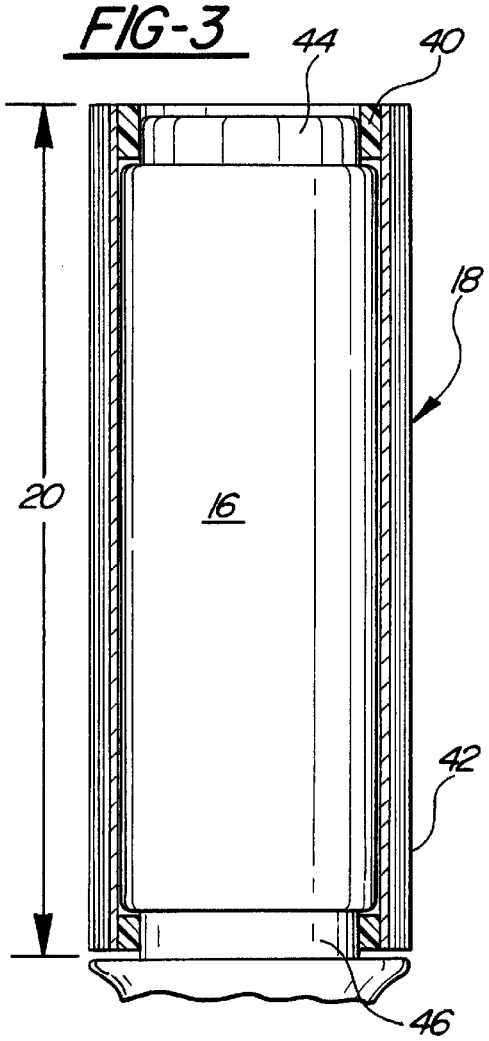
FIG. 3 is a view similar to FIG. 2 but illustrating a second preferred embodiment of the present invention.

With reference now to FIG. 3, a modification of the present invention is there shown in which the lint roller 18 includes two cores 40 and 42 which are longitudinally spaced from each other and in which the total longitudinal length of the core 40 is less than the longitudinal length 20 of the lint roller 18. Each core 40 and 42 registers with and is received within a radially recessed and circumferentially extending channel 44 and 46, respectively, formed on the lint roller support section 16. These channels 40 and 46 are respectively dimensioned to receive the cores 40 and 42 such that the cores 40 and 42 not only retain the lint roller 18 to the lint roller support section 16, but also enable the free rotation of the lint roller 18 relative to the lint roller support section 16.

It will be understood, of course, that the lint roller 18 may include three or even more cores. Furthermore, in the preferred embodiment of the invention, the handle 14 and lint roller support section 16 are preferably of a one-piece plastic construction.

Since the longitudinal or axial length of the core is substantially less than the axial length of the adhesive roll 30, the frictional contact between the core and the lint roller support section 16 is minimized thus enhancing the free rotation of the lint roller 18 relative to the lint roller support section 16. Furthermore, the previously known chafing or abrasion between the core and the end of the lint roller is completely eliminated.

Having described my invention, many modifications thereto will become apparent to those skilled in the art to which it pertains without deviation from the spirit of the invention as defined by the scope of the appended claims.

I claim:

1. A lint roller assembly comprising:

an elongated housing having a handle and a lint roller support section longitudinally adjacent said handle, said lint roller support section being substantially cylindrical in shape and having a radially recessed and circumferentially extending channel formed between its ends, said channel having a longitudinal length substantially less than the longitudinal length of said lint roller support section, a lint roller having a tubular cylindrical core and an adhesive sheet roll wound around said core, said core having a longitudinal length and inside diameter dimensioned to fit into said channel, said longitudinal length of said core being less than the longitudinal length of said adhesive roll wherein said inside diameter of said tubular and cylindrical core is substantially the same as an outside diameter of said lint roller cylindrical support section and wherein said support section has an axial length substantially the same as said lint roller.

2. The invention as defined in claim 1 and comprising a second radially recessed and circumferentially extending channel formed in said lint roller support section, said second channel being longitudinally spaced from said first mentioned channel, wherein said core comprises a pair of spaced apart tubular sections, each section dimensioned to fit into one of said channels, wherein the total longitudinal length of said tubular sections is less than the longitudinal length of said adhesive roll.

3. The invention as defined in claim 1 wherein said handle and said lint roller support section are of a one-piece construction.

4. The invention as defined in claim 3 wherein said handle and lint roller support section are constructed of plastic.

5. The invention as defined in claim 1 wherein the inside diameter of said core is substantially the same or slightly less than the outside diameter of said lint roller support section.

6. A lint roller assembly comprising:

an elongated housing having a handle and a lint roller support section longitudinally adjacent said handle, said lint roller support section being substantially cylindrical in shape and having a radially recessed and circumferentially extending channel formed between its ends, said channel having a longitudinal length less than the longitudinal length of said lint roller support section, a lint roller having a tubular cylindrical core and an adhesive sheet roll wound around said core, said core having a longitudinal length and inside diameter dimensioned to fit into said channel, said longitudinal length of said core being less than the longitudinal length of said adhesive roll, a second radially recessed and circumferentially extending channel formed in said lint roller support section, said second channel being longitudinally spaced from said first mentioned channel, wherein said core comprises a pair of spaced apart tubular sections, each section dimensioned to fit into one of said channels, wherein the total longitudinal length of said tubular sections is less than the longitudinal length of said adhesive roll.

7. A lint roller assembly comprising:

an elongated housing having a handle and a lint roller support section longitudinally adjacent said handle, said lint roller support section being substantially cylindrical in shape and having a radially recessed and circumferentially extending channel formed between its ends, said channel having a longitudinal length less than the longitudinal length of said lint roller support section, a lint roller having a tubular cylindrical core and an adhesive sheet toll wound around said core, said core having a longitudinal length and inside diameter dimensioned to fit into said channel, said longitudinal length of said core being less than the longitudinal length of said adhesive roll, wherein said handle and said lint roller support section are of a one-piece construction.

8. The invention as defined in claim 7 wherein said handle and lint roller support section are constructed of plastic.

* * * * *